US007619596B2

(12) United States Patent
Tada

(10) Patent No.: US 7,619,596 B2
(45) Date of Patent: Nov. 17, 2009

(54) IMAGE PROCESSING APPARATUS AND METHOD OF SAME

(75) Inventor: Mitsuru Tada, Kanagawa (JP)

(73) Assignee: Sony Corporation, Tokyo (JP)

( * ) Notice: Subject to any disclaimer, the term of this patent is extended or adjusted under 35 U.S.C. 154(b) by 596 days.

(21) Appl. No.: 10/931,964

(22) Filed: Sep. 2, 2004

(65) Prior Publication Data

US 2005/0052369 A1 Mar. 10, 2005

(30) Foreign Application Priority Data

Sep. 9, 2003 (JP) ..... P2003-316282

(51) Int. Cl.
*G09G 3/30* (2006.01)
*G09G 3/32* (2006.01)

(52) U.S. Cl. ..... 345/77; 345/82

(58) Field of Classification Search ..... 345/204, 345/647, 76, 77, 82, 83, 596, 690, 694–698; 348/441, 443–446; 315/169.1, 169.3; 382/251–253
See application file for complete search history.

(56) References Cited

U.S. PATENT DOCUMENTS

| | | | | |
|---|---|---|---|---|
| 5,585,856 | A * | 12/1996 | Nakaya et al. | 348/441 |
| 5,721,791 | A * | 2/1998 | Maeda et al. | 382/253 |
| 7,158,157 | B2 * | 1/2007 | Yamazaki et al. | 345/691 |
| 2004/0233125 | A1 * | 11/2004 | Tanghe et al. | 345/1.3 |
| 2005/0259089 | A1 * | 11/2005 | Yamazaki et al. | 345/204 |

FOREIGN PATENT DOCUMENTS

| | | |
|---|---|---|
| JP | 2000-115802 | 4/2000 |
| JP | 2000-132139 | 5/2000 |
| JP | 2000-260331 | 9/2000 |
| JP | 2000-352953 | 12/2000 |
| JP | 2002-169509 | 6/2002 |
| JP | 2002-207475 | 7/2002 |
| JP | 2003-177713 | 6/2003 |
| JP | 08-234683 A | 9/2008 |

OTHER PUBLICATIONS

Japanese Office Action; Application No. 2003-316282; Jan. 30, 2007.

* cited by examiner

*Primary Examiner*—Kevin M Nguyen
(74) *Attorney, Agent, or Firm*—Rader, Fishman & Grauer PLLC

(57) ABSTRACT

An image processing apparatus capable of supplementing luminance by an amount of deterioration even if the degree of deterioration of a light emitting element of a pixel advances along with aging, comprising an image information extraction unit for quantizing an input image by threshold values Vth designated from a CPU and adding the quantized image to an image quantized in a previous frame in units of dots; a memory for storing the image data quantized and added for each frame; a CPU for reading out the image data stored in the memory, monitoring the deterioration degree for each pixel, and outputting a γ-conversion table for the suitable γ-correction for each pixel to an image processing unit when burn-in becomes remarkable; and an image processing unit for performing γ-correction for reducing the deterioration for each pixel for each color based on the γ-conversion table.

15 Claims, 11 Drawing Sheets

FIG. 9A

| | | | | | |
|---|---|---|---|---|---|
| 3 | 0 | 3 | 1 | 2 | 0 |
| 2 | 3 | 1 | 3 | 2 | 3 |
| | | | | | |
| | | | | | |

FIG. 9B

| | | | | | |
|---|---|---|---|---|---|
| 2 | 1 | 2 | 2 | 1 | 1 |
| 1 | 2 | 2 | 2 | 1 | 2 |
| | | | | | |
| | | | | | |

NUMERICAL VALUES IN FIGURE ARE DETERIORATION DEGREES OF PIXELS

FIG. 9C

| | | | | | |
|---|---|---|---|---|---|
| -1 | 1 | -1 | 1 | -1 | 1 |
| -1 | -1 | 1 | -1 | -1 | -1 |
| | | | | | |
| | | | | | |

NUMERICAL VALUES IN FIGURE ARE LUMINANCE CORRECTION DEGREES FOR PIXELS

IMAGE PROCESSING APPARATUS AND METHOD OF SAME

BACKGROUND OF THE INVENTION

1. Field of the Invention

The present invention relates to an organic EL (electroluminescence) display or other image processing apparatus applying predetermined processing to an input image to display the image on a display unit and a method of the same.

2. Description of the Related Art

In an image display device, for example, a liquid crystal display, a large number of pixels are arranged in a matrix and the light intensity is controlled for every pixel in accordance with the image information to be displayed so as to display an image. This same is true for an organic EL display etc. An organic EL display is a so-called self light emitting type display having a light emitting element in each pixel circuit and has the advantages that the viewability of the image is higher in comparison with a liquid crystal display, a backlight is unnecessary, the response speed is high, etc. Further, it greatly differs from a liquid crystal display etc. in that the luminance of each light emitting element is controlled by the value of the current flowing through it. That is, each light emitting element is of the current controlled type.

An organic EL display, in the same way as a liquid crystal display, may be driven by a simple matrix and an active matrix system, but while the former has a simple structure, it has the problem that realization of a large sized and high definition display is difficult. For this reason, much effort is being devoted to development of the active matrix system of controlling the current flowing through the light emitting element inside each pixel circuit by an active element provided inside the pixel circuit, generally, a thin film transistor (TFT).

FIG. 1 is a circuit diagram of the configuration of first example of the configuration of an active matrix type organic EL display (see for example U.S. Pat. No. 5,684,365 and Japanese Unexamined Patent Publication (Kokai) No. 8-234683).

A pixel circuit 10 of FIG. 1 has a p-channel thin film field effect transistor (hereinafter referred to as a "TFT") 11, an n-channel TFT 12, a capacitor C11, and a light emitting element 13 constituted by an organic EL element. Further, in FIG. 1, DTL indicates a data line, and WSL indicates a scanning line. An organic EL element has a rectification property in many cases, so sometimes is referred to as an organic light emitting diode (OLED). The symbol of a diode is used as the organic EL element in FIG. 1 and the other figures, but a rectification property is not always required for the organic EL element in the following explanation. In FIG. 1, a source of the TFT 11 is connected to a power supply potential VCC, and a cathode of the light emitting element 13 is connected to a ground potential GND. The operation of the pixel circuit 10 of FIG. 1 is as follows.

When the scanning line WSL is made a selected state (high level here) and a write potential Vdata is supplied to the data line DTL, the TFT 12 becomes conductive, the capacitor C11 is charged or discharged, and the gate potential of the TFT 11 becomes Vdata.

When the scanning line WSL is made a non-selected state (low level here), the data line DTL and the TFT 11 are electrically separated, but the gate potential of the TFT 11 is held stably by the capacitor C11.

The current flowing through the TFT 11 and the organic EL element 13 becomes a value in accordance with a gate-source voltage Vgs of the TFT 11, while the light emitting element 13 is continuously emitting light with a luminance in accordance with the current value. As in the above, the operation of selecting the scanning line WSL and transmitting the luminance information given to the data line to the inside of a pixel will be referred to as "writing" below. As explained above, in the pixel circuit 2*a* of FIG. 1, if once the Vdata is written, the light emitting EL element 13 continues to emit light with a constant luminance in the period up to the next rewrite operation.

FIG. 2 is a circuit diagram of a second example of the configuration of a pixel circuit in an active matrix type organic EL display.

A pixel circuit 20 of FIG. 2 has a p-channel TFT 21, a TFT 22, an n-channel TFT 23, a TFT 24, a capacitor C21, and a light emitting element 25 constituted by an organic EL element. Further, in FIG. 2, DTL indicates a data line, WSL indicates a scanning line, and ESL indicates an erasing line. An explanation will be given below of the operation of this pixel circuit 20 while referring to the timing chart shown in FIGS. 3A to 11E.

First, in a state (period) <1>, as shown in FIGS. 3C and 3D, a scanning signal WS applied to the scanning line WSL and an erasing signal ES applied to the erasing line ESL are set at the high level. Due to this, the TFT 24 and the TFT 23 become an ON state, the TFT 22 becomes an OFF state, and a charge in accordance with the data VDATA amount is stored in the capacitor C21 by the data line DTL.

In a state (period) <2>, as shown in FIGS. 3C and 3D, the scanning signal WS to the scanning line WSL and the erasing signal ES to the erasing line ESL are set at the low level. Due to this, the TFT 24 and the TFT 23 become the OFF state, the TFT 22 becomes the OFF state, and a current in accordance with the charge stored in the capacitor C21 flows in the EL light emitting element 25 through the TFT 21. This current is maintained until the signal ES applied to the erasing line ESL becomes the high level.

In a state (period) <3>, as shown in FIG. 3D, the erasing signal ES to the erasing line ESL is set at the high level. Due to this, the TFT 23 and the TFT 22 become the ON state, so the charge stored in the capacitor C21 is discharged through the TFT 23 and the TFT 22, and the light emission of the EL light emitting element 25 is turned OFF there.

In this way, the circuit of FIG. 2 controls the light emission period (DUTY) of the light emitting element 25 unambiguously by using one erasing line ESL by each pixel.

The fact that the light emitting element in an organic EL display has a characteristic deteriorating in proportion to the light emitting amount and time is generally known. Improvement of the characteristic of the light emitting element is hoped for. On the other hand, the display screen of the display is not always uniform, so deterioration of the light emitting elements in the screen is not uniform and becomes a factor of partial deterioration of the light emitting elements. In particular, in the display of the time etc., only that portion extremely deteriorates and drops in luminance. This is generally referred to as "burn-in" (hereinafter, partial pixel deterioration will be described as "burn-in"). Further, in a case where a plurality of light emitting elements are used or even in the case of a single light emitting element having a plurality of emission wavelength components, often the deterioration characteristics do not match. In this case, in the deteriorated pixel portion, the white balance becomes off and that portion appears colored.

To deal with burn-in of the screen due to deterioration of the display elements accompanying the light emission time, it has been considered best to improve the light emission lifetime of the display element material. Other than improving the material, in the past burn-in has been prevented by using circuits positively discharging the held capacitance of pixels (see for example Japanese Unexamined Patent Publication (Kokai) No. 2002-169509) to suppressing the unrequired light emission time. Further, an apparatus using a screen saver etc. to relieve burn-in has been proposed (see for example Japanese Unexamined Patent Publication (Kokai) No. 2002-207475).

However, while it is possible to improve the light emission lifetime of the display element material so as to extend the light emission lifetime of the display element material in a self light emitting type display somewhat, it is impossible to completely eliminate burn-in in principle. Further, looking at the video signal to be displayed on the display device, depending on its application, sometimes only a video signal easily causing burn-in is input. That is, burn-in cannot be prevented by only just improving the service life of the conventional material. Further, so long as the service life of the material is not extended, burn-in of the screen cannot be alleviated. It has therefore been necessary to rely on developments in this field such as the speed and costs of material development.

Circuits that positively discharge the held capacitance of the pixels disclosed in Japanese Unexamined Patent Publication (Kokai) No. 2002-169509 and the circuits disclosed in Japanese Unexamined Patent Publication (Kokai) No. 2002-207475) cannot however compensate for or ease the deterioration of the emission luminance accompanied with burn-in, that is, deterioration of the pixels, to an extent suitable for practical use.

SUMMARY OF THE INVENTION

An object of the present invention is to provide an image processing apparatus capable of correcting the deterioration of the light emitting elements of pixels along with aging of pixels and capable of making up for the deterioration of the luminance even if deterioration of the light emitting elements of pixels advances along with aging and a method of the same.

To attain the above object, according to a first aspect of the present invention, there is provided an image processing apparatus comprising a deterioration degree information extracting means for digitalizing an input image signal and extracting luminance deterioration degree information based on the digitalized information; an image conversion designating means for selecting and designating an optimum image conversion method based on the luminance deterioration degree information obtained by the deterioration degree information extracting means; and an image processing means for performing conversion processing on an input image based on the optimum image conversion method designated by the image conversion designating means.

Preferably, the apparatus has a storing means for storing the luminance deterioration degree information extracted by the deterioration degree information extracting means, and the image conversion designating means selects the optimum image conversion method based on the luminance deterioration degree information stored in the storing means and designates the same to the image processing means.

Preferably, the deterioration degree information extracting means adds the digitalized image to the image digitalized in the previous frame in unit of dots and stores the added data for each pixel in the storing means.

Preferably, the image conversion designating means calculates the deterioration degree by referring to the added data of the luminance deterioration degree information stored in the storing means and, when a luminance difference between a pixel having a small deterioration degree and a pixel having a large deterioration degree becomes larger than a reference value set in advance, selects a conversion method giving a small luminance difference and designates the same to the image processing means.

More preferably, the image conversion designating means calculates the deterioration degree by referring to the added data of the luminance deterioration degree information stored in the storing means and, when a luminance difference between a pixel having the smallest deterioration degree and a pixel having the largest deterioration degree becomes larger than a reference value set in advance, selects a conversion method giving a small luminance difference and designates the same to the image processing means.

Preferably, the conversion method includes a γ-conversion method, the image conversion designating means supplies γ-conversion table information to the image processing unit, and the image processing unit performs γ-correction for making the luminance difference small for each pixel based on the γ-conversion table.

Preferably, the deterioration degree information extracting means performs the digitalization processing with respect to gradation information of the image and, in an initial state, increases the resolution of the threshold values for digitalization at a low gradation side.

Further, the luminance deterioration degree information extracting means increases the resolution of the threshold values for digitalization at a high gradation side as the luminance deterioration of the pixels advances.

According to a second aspect of the present invention, there is provided an image processing method comprising a first step of digitalizing an input image signal; a second step of obtaining luminance deterioration degree information at a display based on the digitalized information; a third step of storing the obtained luminance deterioration degree information; a fourth step of monitoring said stored luminance deterioration degree information and selecting and designating an optimum image conversion method in accordance with the luminance deterioration degree; and a fifth step of performing conversion processing on the input image based on the designated optimum image conversion method.

According to the present invention, for example the luminance deterioration degree information extracting means digitalizes the input image signal based on predetermined threshold values and obtains luminance deterioration degree information at the display based on the digitalized information. Then, the luminance deterioration degree information obtained in the luminance deterioration degree information extracting means is stored in the storing means. The luminance deterioration degree information stored in the storing means is monitored by the image conversion designating means. The image conversion designating means selects the optimum image conversion method in accordance with the luminance deterioration degree as a result of the monitoring and designates the same to the image processing means. The image processing means performs the conversion processing on the input image based on the designated optimum image conversion method.

BRIEF DESCRIPTION OF THE DRAWINGS

These and other objects and features of the present invention will become clearer from the following description of the preferred embodiments given with reference to the attached drawings, wherein:

FIGS. 9A to 9C are views for explaining a concrete example of a correction method based on luminance deterioration information;

DESCRIPTION OF THE PREFERRED EMBODIMENTS

Below, a detailed explanation will be given of embodiments of the present invention with reference to the drawings.

Figure 1:
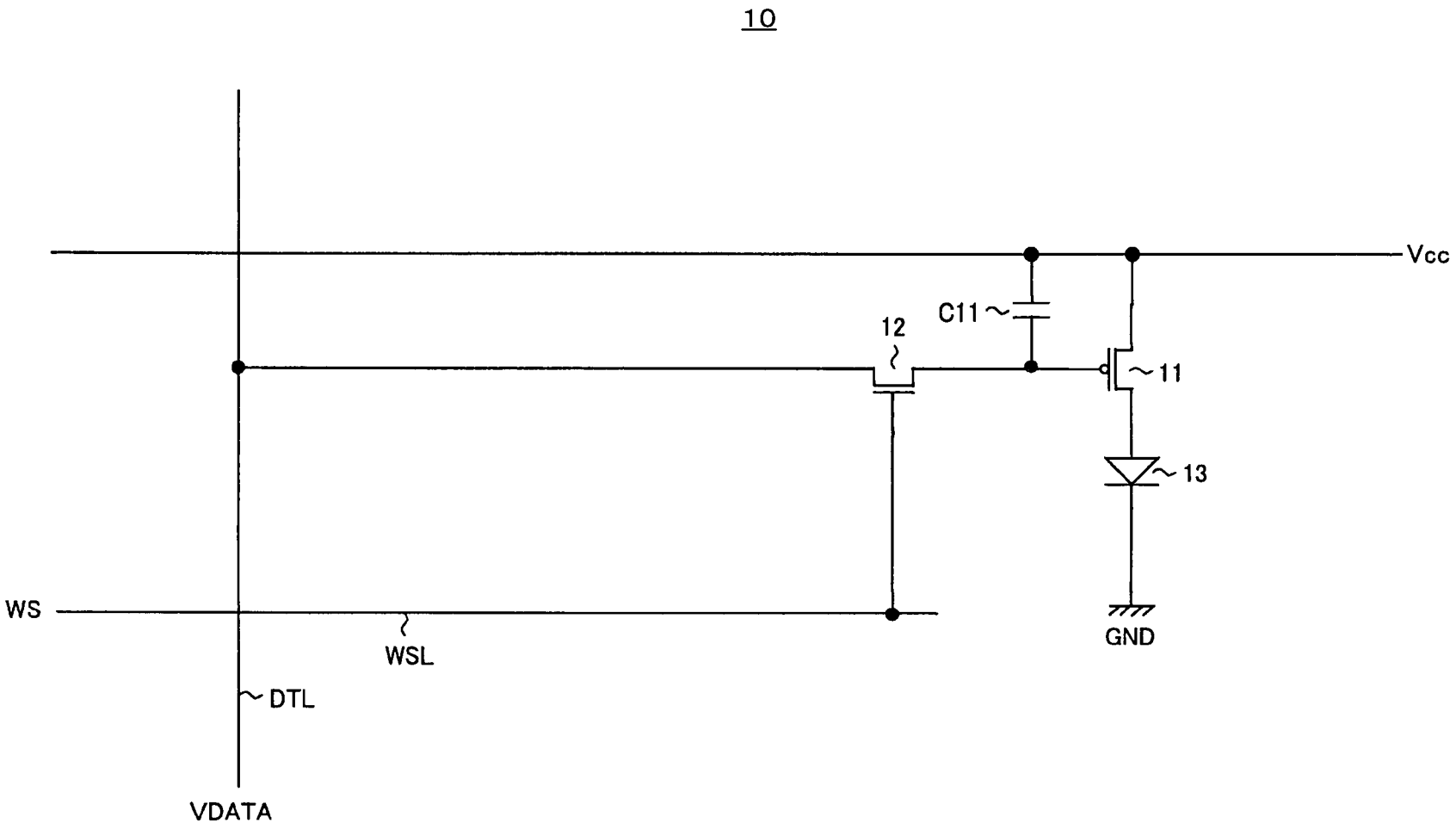
FIG. 1 is a circuit diagram of a first example of the configuration of a pixel circuit in an active matrix type organic EL display.
Figure 2:
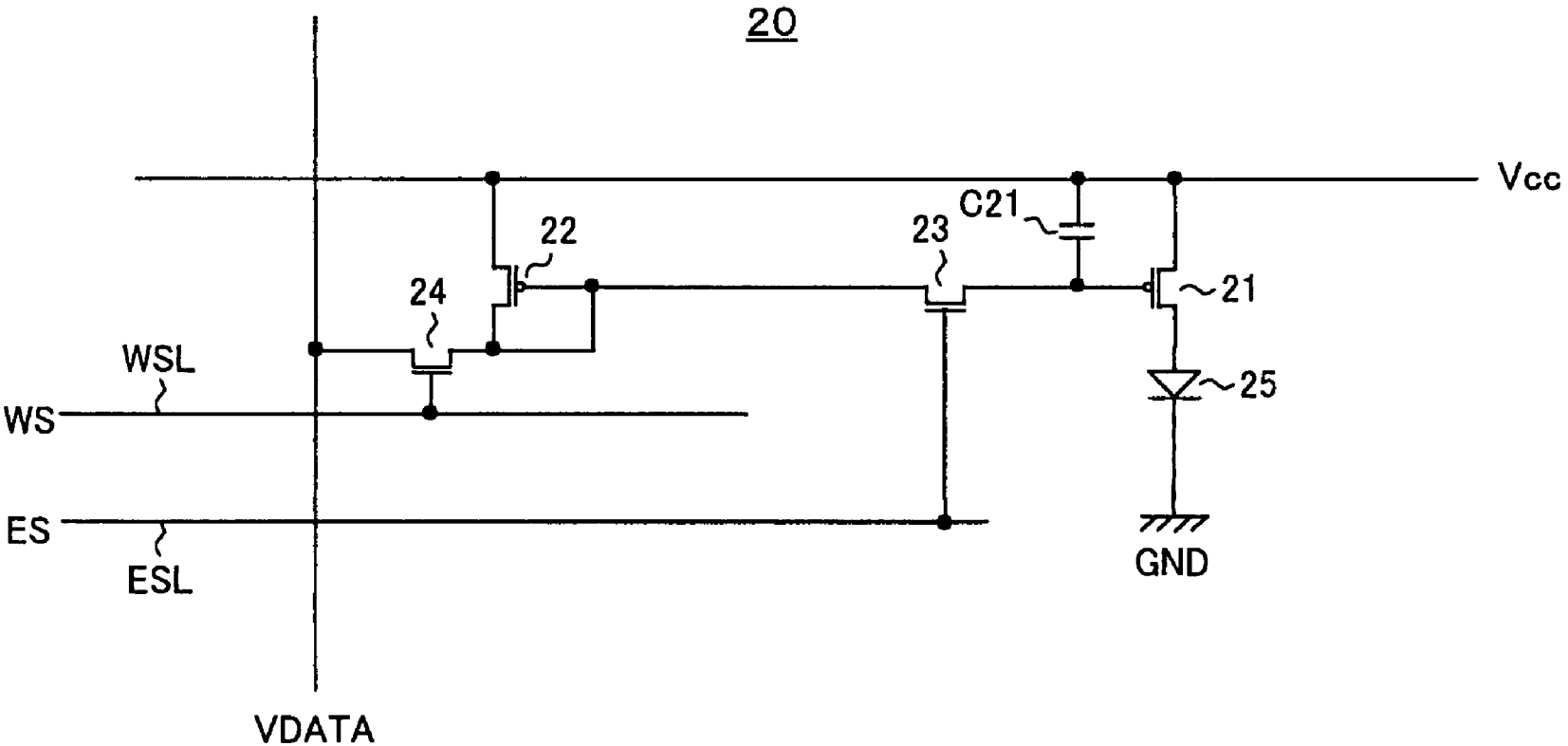
FIG. 2 is a circuit diagram of a second example of the configuration of the pixel circuit in an active matrix type organic EL display.
Figures 3A, 3B, 3C, 3D, 3E:
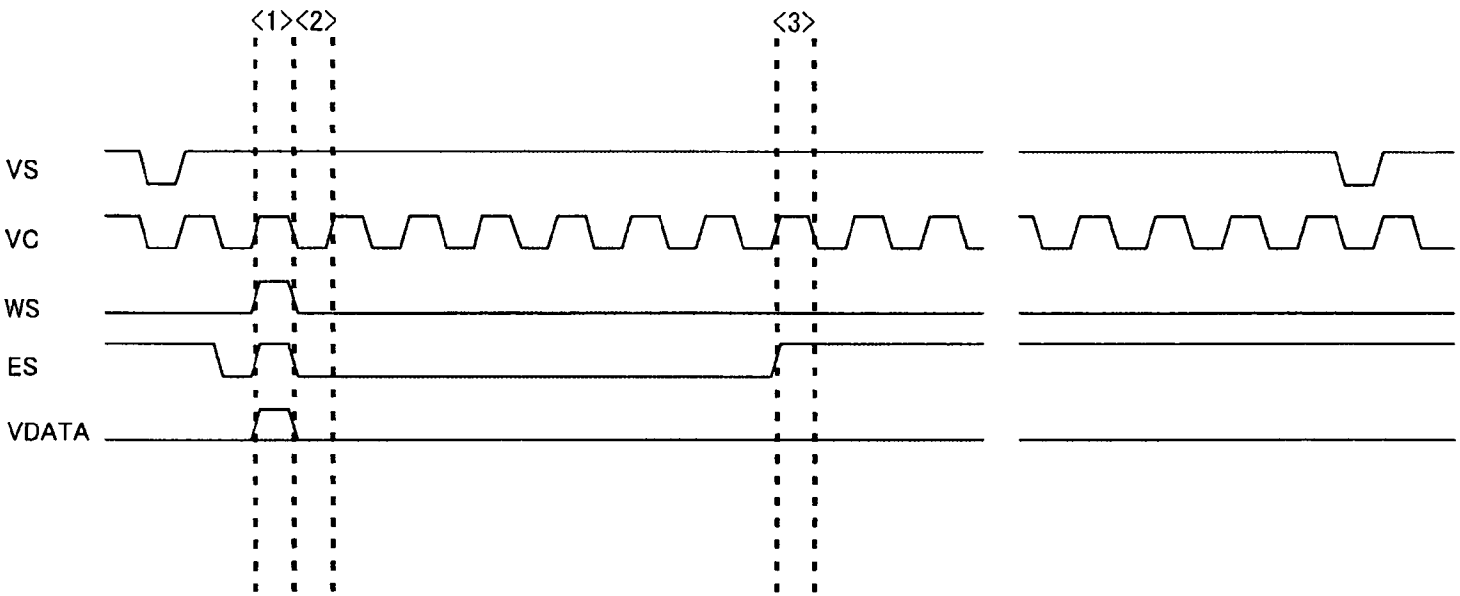
FIGS. 3A to 3E are timing charts for explaining the operation of the circuit of FIG. 2.
Figure 4:
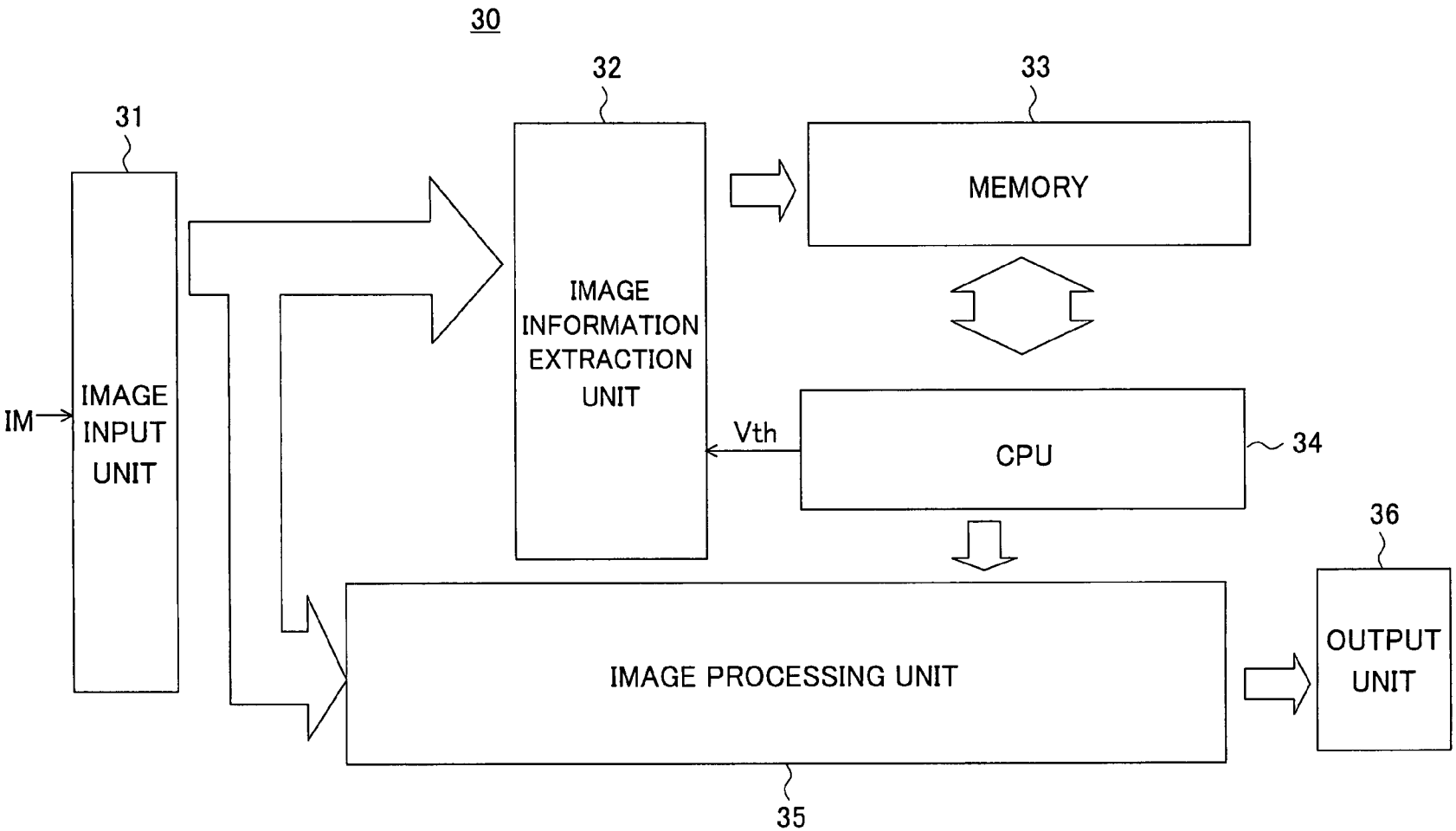
FIG. 4 is a block diagram of the configuration of an embodiment of an image processing apparatus according to the present invention.

FIG. 4 is a block diagram of the configuration of an embodiment of an image processing apparatus according to the present invention.

The image processing apparatus 30, as shown in FIG. 4, has an image input unit 31, an image information extraction unit 32 as an luminance deterioration degree information extracting means, a memory 33, a CPU 34 as an image conversion designating means, an image processing unit 35, and an output unit 36.

The image input unit 31 inputs an input image IM to the image information extraction unit 32 and the image processing unit 35.

The image information extraction unit 32 quantizes the image input by the image input unit 31 by threshold values Vth designated from the CPU 34. The image information extraction unit 32 adds the quantized image to the image quantized in the previous frame in unit of dots and outputs the result to the memory 33.

Figure 5:
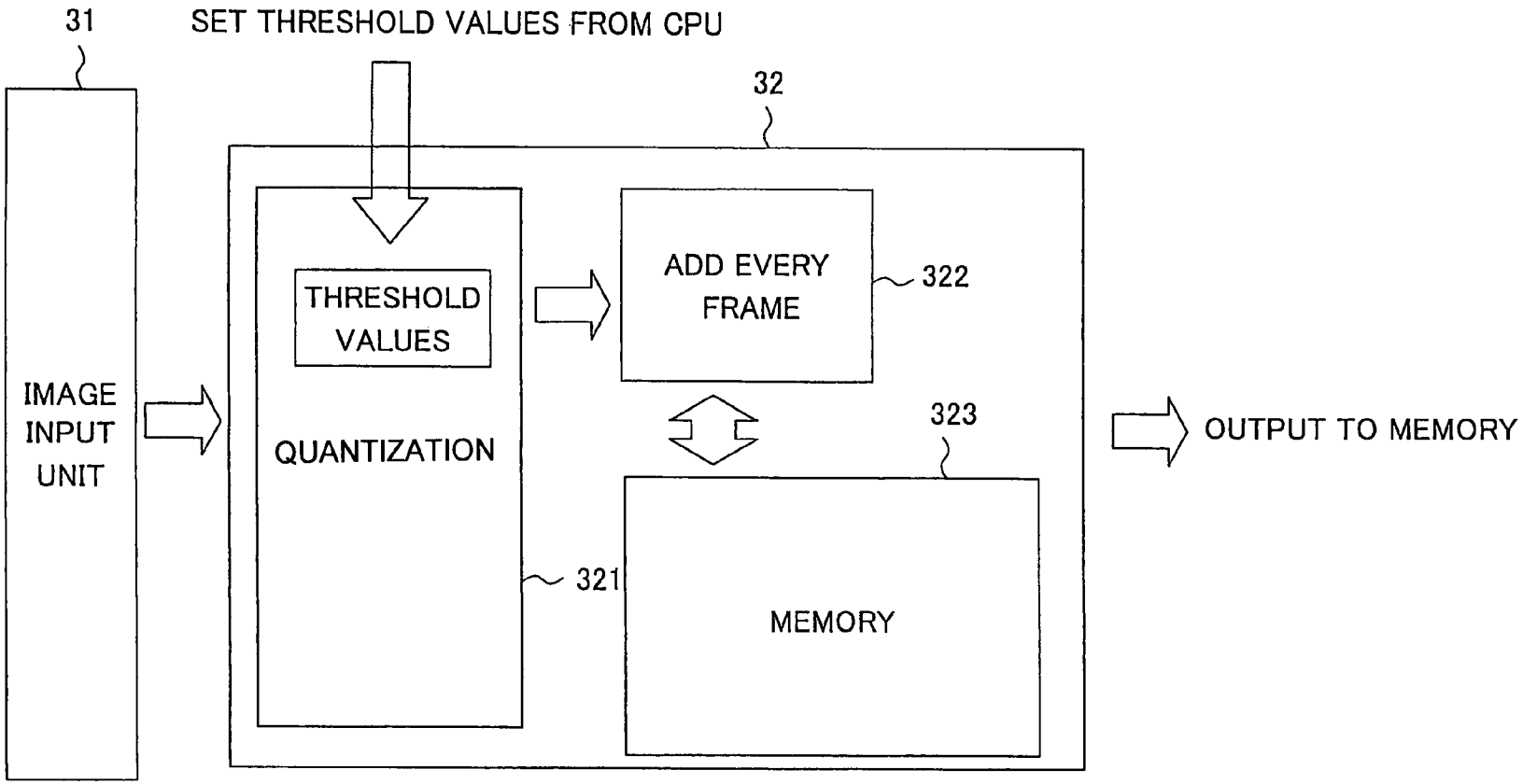
FIG. 5 is a block diagram of a concrete example of the configuration of an image information extraction unit according to an embodiment of the present invention.

FIG. 5 is a block diagram concretely showing an example of the configuration of the image information extraction unit according to the present embodiment. This image information extraction unit 32, as shown in FIG. 5, has a quantization unit 321, a computation unit 322, and a memory 323.

The detailed processing of each part will be explained with reference to FIGS. 6A and 6B.

Figure 6A:
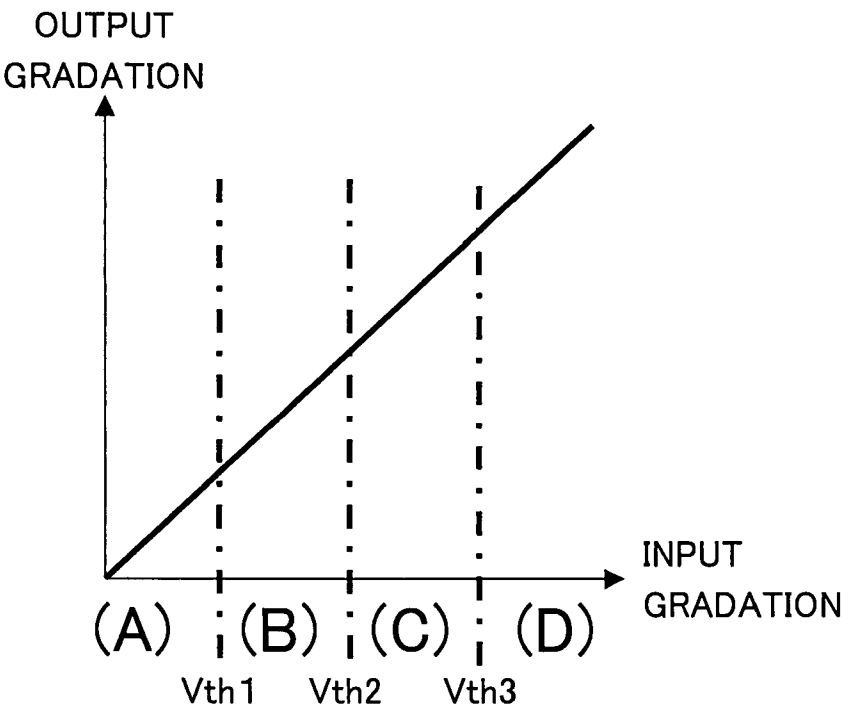
FIGS. 6A and 6B are views for explaining a quantization method for extracting deterioration information of the image information extraction unit according to an embodiment of the present invention.
Figure 6B:
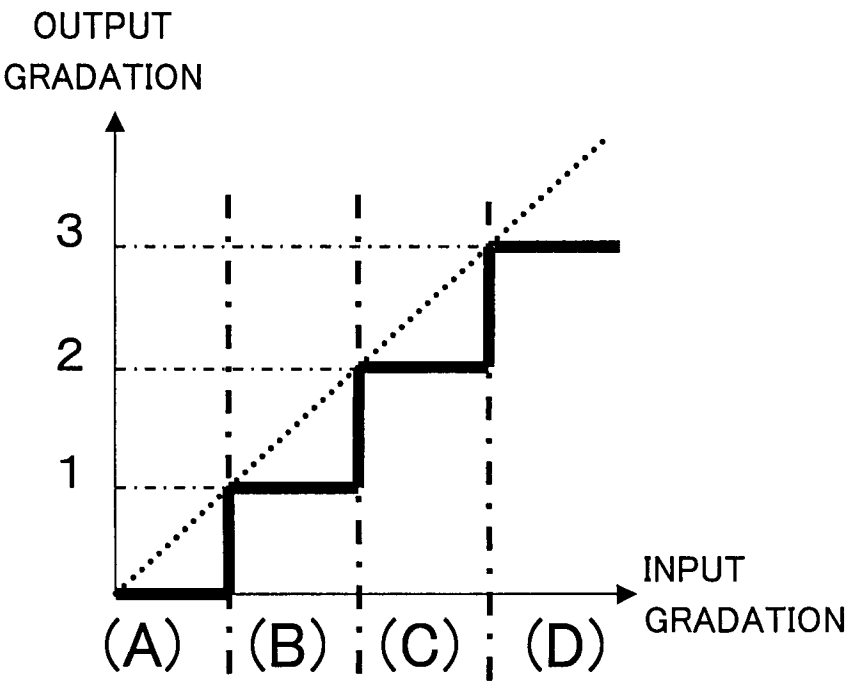

The quantization unit 321 divides the gradation of the image input by the image input unit 31 to areas A, B, C, and D based on three threshold values Vth1 to Vth3 designated from the CPU 34 as shown in FIG. 6A. Then, the quantization unit 321 quantizes the image to 0, 1, 2, and 3 in divided areas (A) to (D) as shown in FIG. 6B. In this way, the quantization unit 321 quantizes the input image for each dot and outputs this quantized information to the computation unit 322. The computation unit 322 receives the quantized information quantized for each dot in the quantization unit 321, adds them in unit of frames, stores the computed value for each pixel in the memory 323, outputs the data image quantized and added for each frame to the memory 33, and stores the added image for each dot.

The memory 33 is configured by a nonvolatile memory holding a value even if for example the power is turned off, stores the image data quantized in the image information extraction unit 32 and added for each frame (added data added for each dot), and is accessed by the CPU 34 according to need for extraction of the data. The memory 33 stores the information subjected to γ-processing by the CPU 34 for each pixel.

The CPU 34 reads out the image data stored in the memory 33, monitors the deterioration degree for each pixel, and if burn-in becomes remarkable, outputs γ-conversion table information for suitable γ-correction for each pixel to the image processing unit 35 (selects and designates the γ-conversion table). The CPU 34 usually only monitors the deterioration condition (deterioration degree). Specifically, the CPU 34 calculates the deterioration condition with respect to numerical value set in advance by referring to the added data stored in the memory 33 and monitors the deterioration degree by comparing whether or not the difference between the least deteriorated pixel and the most deteriorated pixel becomes larger than the set value. Then, if there is a difference of a certain amount or more in the deterioration degree, the CPU 34 sets processing for making the difference smaller in the γ-conversion unit of the image processing unit 35.

The image processing unit 35 performs the γ-correction for making the deterioration smaller for each pixel for each color based on the γ-conversion table instructed from the CPU 34.

The output unit 36 outputs the image input from the image processing unit 35 at the same timing as the format of the input signal.

The operation in the image processing apparatus of FIG. 4 configured as described above will be explained next.

First, the input image IM is input by the image input unit 31 to the image information extraction unit 32 and the image processing unit 35. The image information extraction unit 32 quantizes the input image with the threshold values designated from the CPU 34. Concretely, the quantization unit 3221 first divides the input halftone to four areas (A), (B), (C), and (D) with the threshold values designated from the CPU 34 as shown in FIG. 6A and quantizes the image to 0, 1, 2, and 3 for each area as shown in FIG. 6B. Further, it quantizes the input image for each dot and adds the results in unit of frames at the computation unit 322. The computed value for each pixel is stored in the memory 333. The quantized image is added to the image quantized in the previous frame and the result output to the memory 33. The memory 33 stores the image data quantized and added for each dot. The CPU 34 reads out the image data stored in the memory 33 and monitors the deterioration degree for each pixel. The CPU 34 outputs a γ-conversion table for suitable γ-correction for each pixel to the image processing unit 35 when the result of the monitoring shows that burn-in has become remarkable. The image processing unit 35 selects the γ-conversion table for each pixel and performs the γ-correction for making the deterioration smaller for each pixel for each color based on this.

Figure 7:
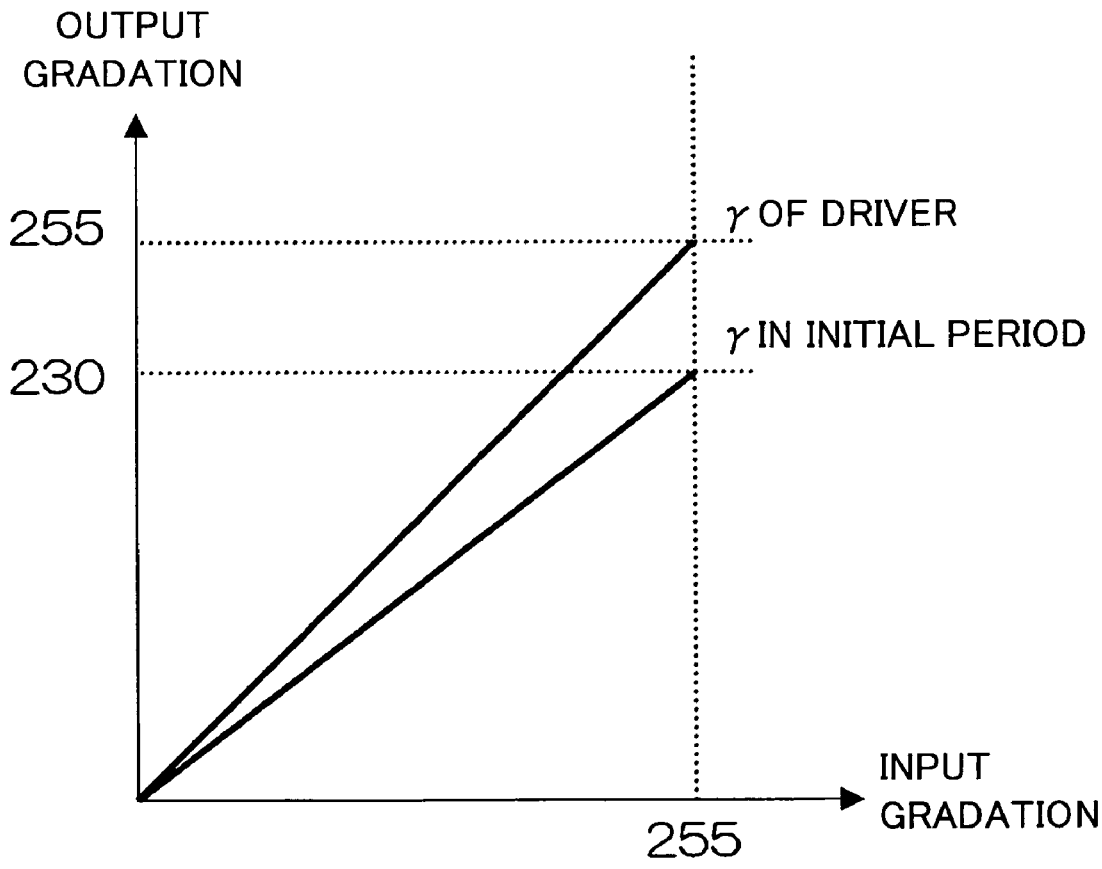
FIG. 7 is an explanatory view of a γ-value at an initial stage of an image processing unit according to the present embodiment.
Figure 8A:
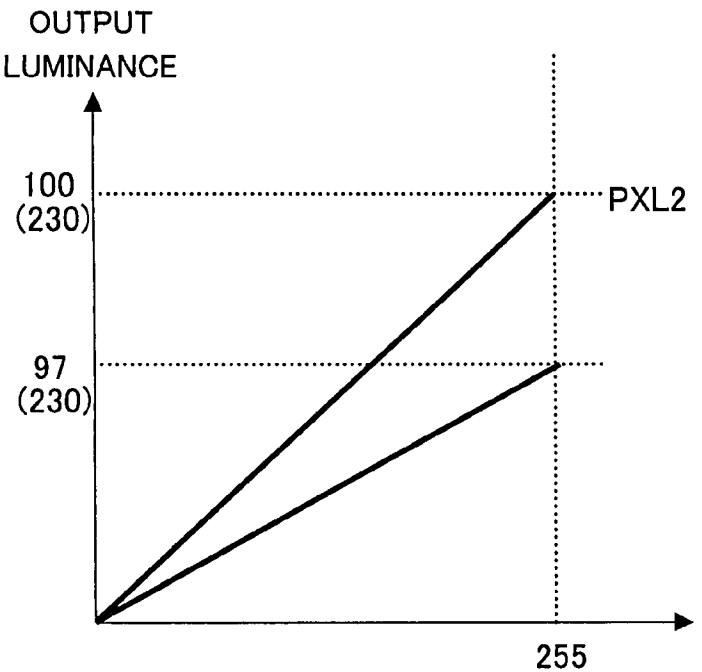
FIGS. 8A and 8B are views for explaining a concrete example of γ-correction.
Figure 8B:
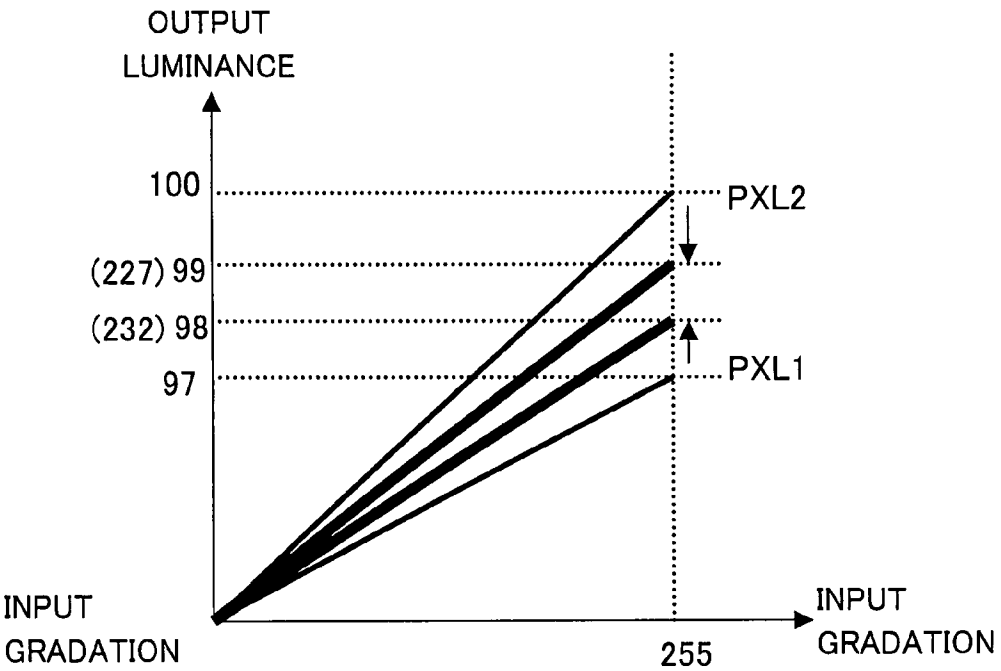

Below, an explanation will be given of the principle of correction of the γ-correction in the image processing unit 35 with reference to FIG. 7, FIGS. 8A and 8B, and FIGS. 9A to 9C. FIG. 7 is an explanatory view of the γ-value at the initial stage in the image processing unit according to the present embodiment. In FIG. 7, the abscissa indicates an input gradation, and the ordinate indicates an output gradation. In this example, both of the input gradation and the output gradation are 8 bits of 256 (0 to 255) gradations. FIGS. 8A and 8B are views for explaining a concrete example of the γ-correction. In FIGS. 8A and 8B, the abscissa indicates the input gradation (8 bits), and the ordinate indicates the output luminance. FIGS. 9A to 9C are views for explaining a concrete example of the correction method based on the luminance deterioration degree information. The numerical values shown in FIGS. 9A to 9C indicate the deterioration degree for each pixel.

At the initial stage, the γ-conversion of the image processing unit 35 is made smaller than the γ of a driver output of the later output unit 36 as shown in FIG. 7. Assume that the deterioration of the pixels advances and, as shown in FIG. 8A, results in an output luminance 100 of a not deteriorated pixel PXL2 and an output luminance 97 of a most deteriorated pixel PXL1. In this state, as shown in FIG. 8B, γ-correction is performed to lower the output luminance of the not deteriorated pixel PXL2 from 100 to 99 and raise the output luminance of the most deteriorated pixel PXL1 from 97 to 98, that is, γ-correction is performed to make the luminance difference between the two pixels smaller. This γ-conversion is carried out for each pixel to correct deterioration. For example, if set for correction at deterioration of 3%, as shown in FIG. 9A, if there is a difference of 3% between the maximum and the minimum of the luminance deterioration, the correction will reduce the difference of the pixels to 1%—by which the luminance difference cannot be discerned much at all—as shown in FIG. 9B. The coefficient used for correction here is shown in FIG. 9C. If correcting with an error of 3%, there are two types of table conversion. When correcting by FPGA, it becomes possible to realize this function with a considerably simple circuit scale. Accordingly, at what percentage of deterioration the deterioration is corrected influences the size of the system and circuit scale.

Note that the memory capacity required for storing the deterioration data of the pixels becomes, in the case where the image resolution is XGA, 17029440000=3 (quantized)×60 (1 frame)×60 (1 minute)×60 (hours)×24 (1 day)×365 (1 year)×3 (years)

Since 17029440000 is a 34-bit size, the result becomes 4.25 Byte×1024×768=3.3 Mbyte.

In this case, only a 3.3 M byte frame memory need be prepared for each color, so a memory having a considerably small memory capacity and in addition having the currently mainstream 32-bit size can be used. This is a considerably realistic correcting means.

Below, an explanation will be given of the method of calculation of the luminance deterioration degree in the CPU 34, a more concrete quantization method, and more effective γ-conversion method.

First, an explanation will be given of the method of calculation of the luminance deterioration degree in the CPU 34. Here, an explanation will be given of two methods.

<First Luminance Deterioration Degree Calculation Method>

This CPU 34, for example, has a built-in clock. It counts the time of the display of the video data on a not illustrated panel, reads out the data added for each pixel from the memory at every certain time interval, and performs computation. The time interval of correction from the counted value can be changed according to the frequency of the use of the panel by the user, for example every day, every week, or every year. The luminance deterioration degree is calculated using the displayed time and the data added for each frame. The deterioration degree with respect to the sum of the numerical values is calculated in advance from a deterioration curve (characteristic curve) of the organic EL device material. The deterioration degree is derived based on that data. For example, where correcting a device halving in luminance after 1000 hours, the maximum total value of any one pixel becomes 864000000. At this time, consider a case where the added total value of a certain pixel is 800 hours of illumination or 164000000. When it is judged that the judgment of the quantization is all 3 in 800 hours, the total value of the quantization becomes 691200000. Therefore, in this case, for the case where all quantized values are 3, the pixel deteriorates by exactly (800×164000000-2)/(800×69120000+2)×100=23.7 [%]. Further, when it is learned that the deterioration is 40% when all judgments in the 800 hours were 3 in this organic EL device, the deterioration degree can be easily calculated as, for example, 40×(23.7/100)=9.48 [%].

<Second Luminance Deterioration Degree Calculation Method>

Below, the method for calculating the luminance deterioration condition of a pixel enabling easy computation at the CPU 34 even if correction is carried out every day is shown. In the correction at a certain point (first time), the computation method of the above first method is used for calculation and the method of the above embodiment is used for processing for changing the γ for every pixel, but in the correction of the second time on, the deterioration degree is calculated as follows. For example, when performing correction as in FIGS. 8A and 8B, the deterioration degree becomes 1 to 2%. The following calculation method will be explained by assuming the count at this time and the light emission time of 20 hours. Assuming that all data in 20 hours are 3, the total count becomes 12960000. The luminance deterioration was 1% in 20 hours, so there are various counts of the pixels, but after the correction, the deterioration degree is reduced to within 1 to 2%, so the counts of the pixels after the correction can be set to be similar or set to 12960000×0.985=12765600 here. In this way, no matter at what time the correction is carried out for equalizing the deterioration degrees of pixels, the counts for the next correction can be made even, so it is possible to simply correct luminance with a higher precision.

<Quantization Method>

In the technique used in this invention, how effectively the method for quantization is performed at the image information extraction unit is an important factor in calculating the deterioration degree. An explanation will be given of a quantization method for obtaining the information for obtaining more correct deterioration data in this invention. In this embodiment, γ-conversion of the input and output gradations is used in a state giving leeway to the gradations in the initial state. Along with the elapse of time, the inclination of the γ-curve is changed. Therefore, calculating the suitable threshold values for the quantization is necessary for computing the correct luminance deterioration degree. For example, an explanation will be given of a case where the computation of correction as in FIGS. 8A and 8B is carried out. In the initial state, the maximum (MAX) gradation is not used in each pixel, so the resolution of the threshold values is made large at the low gradation side. For example, the threshold value of 0 and 1 is set at a 90 gradation, the threshold value of 1 and 2 is set at a 150 gradation, and the threshold value of 2 and 3 is set at a 230 gradation. In actuality, the detailed values are determined matching with the device characteristics of the organic EL. When deterioration of the pixels advances considerably and the inclination of the γ-curve becomes large, the number of pixels shining brightly increases or the time during which the pixels shine brightly increases, so the resolution of the threshold values is enlarged at the high gradation side. By this, more correct quantization can be realized.

<γ-Conversion Method>

Below, an explanation will be given of a more effective γ-conversion method by the technique used in this invention.

Figure 10A:
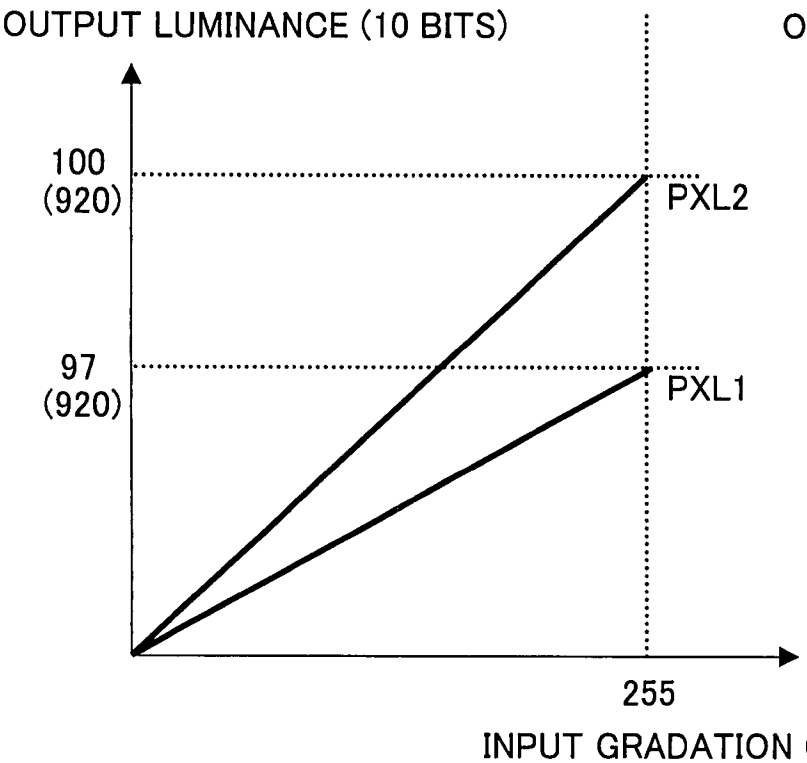
FIGS. 10A and 10B are views for explaining a γ-conversion method in a case of input of 8 bits and output of 10 bits.
Figure 10B:
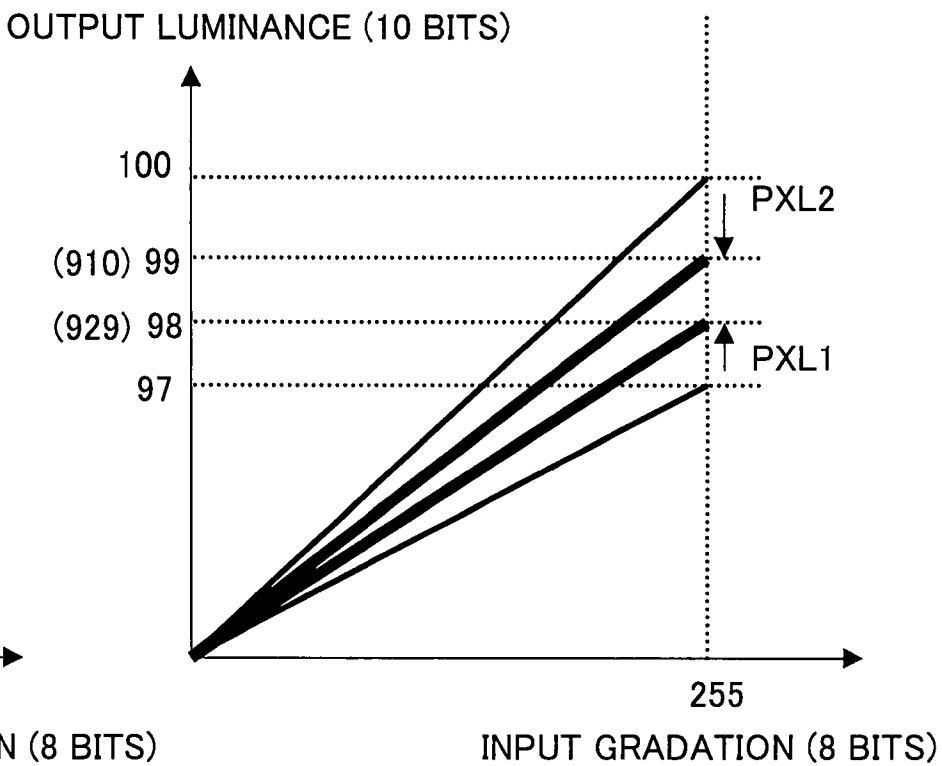
Figure 11:
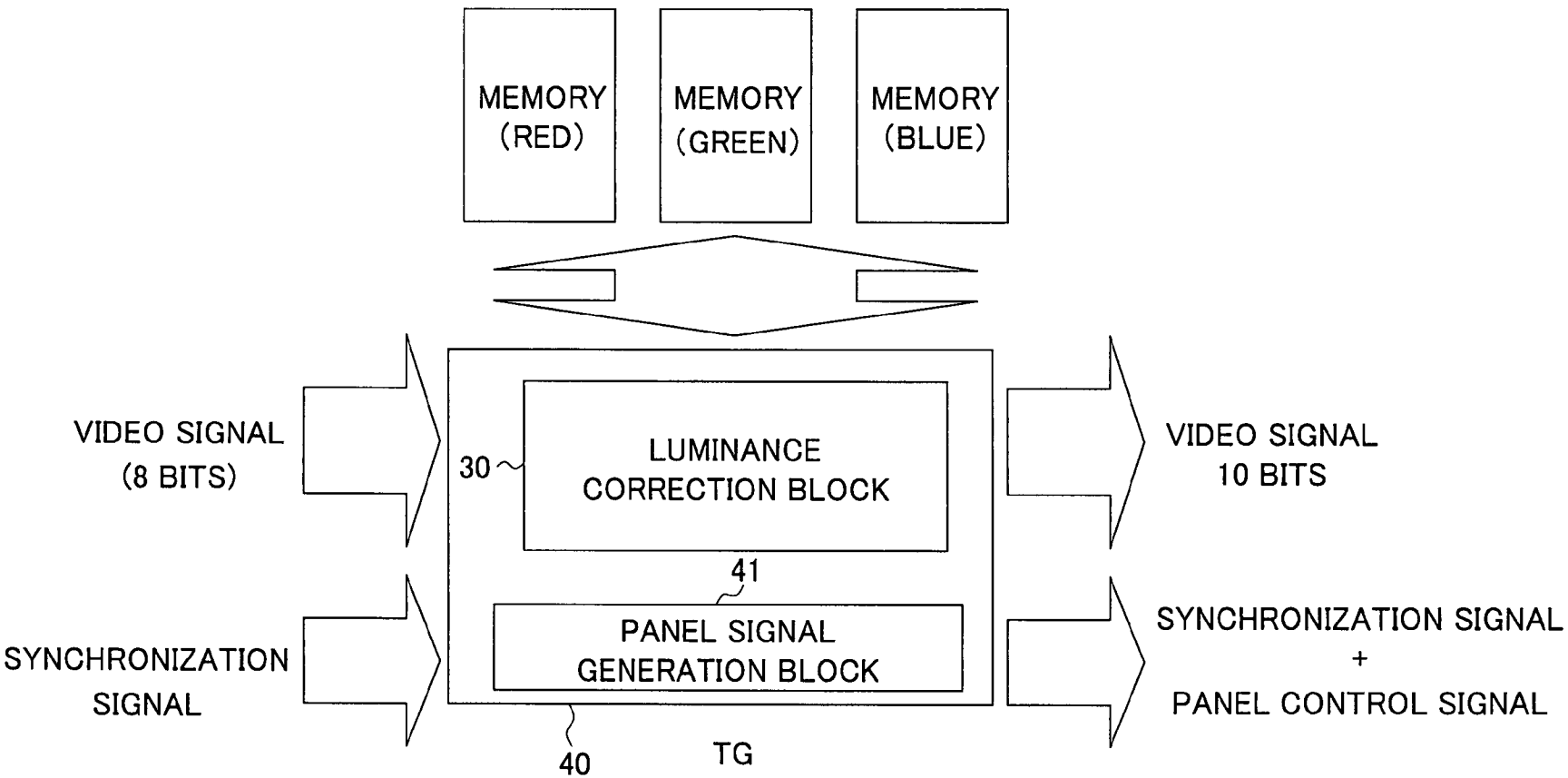
FIG. 11 is a view of an example of an application in the case of input of 8 bits and output of 10 bits.

Up to here, the γ-conversion was explained with the same input of 8 bits and output of 8 bits. To realize this function, it was necessary to sacrifice the gradations of the video signal. By making the input 8 bits and the output 10 bits as in FIGS. 10A and 10B (when applying the same correction value as that in the example explained before), however, this function can be realized without reducing the number of gradations of the input signal. Further, as an example for actual realization, the block diagram as in FIG. 11 is shown. In the example of FIG. 11, the function of the image processing apparatus 30 according to the present embodiment is incorporated in a timing generator 40 used in a flat panel display such as general LDC or organic EL display as a luminance correction block, whereby the function and performance can be improved while maintaining the outer appearance as it is.

<Other Method of Acquiring Deterioration Degree Information>

Next, an explanation will be given of acquiring more effective deterioration degree information by the technique used in this invention. Up to here, it was explained that just by quantization in the image information extraction unit 32, the luminance deterioration degree information was easily extracted and calculation became easy, but more correct information can be obtained by increasing the digitalization to 8, 16, 32, 64, 126, or 256. However, the required memory capacity increases by increasing the threshold values, so it is not desired to increase the threshold values so much. For example, by just 128-izing the video input signal of the resolution XGA, the required memory capacity becomes 720912960000=31 (128-ized)×60 (1 frame)×60 (1 min)×60 (hours)×24 (1 day)×365 (1 year)×3 (years)

Since 720912960000 is a 40 bit size, the memory capacity increases to 5 Byte×1024×768=3.9 Mbyte for one color. In addition the data size per pixel becomes 40 bits, so if using the current mainstream memory, processing increasing the speed of write operation of the data etc. becomes necessary. Note that when 64-bit memories become the mainstream in the future, this will become a realistic technique in terms of cost and terms of circuit scale.

As explained above, according to the present embodiment, provision is made of an image information extraction unit 32 for quadrarizing an image input by the image input unit 31 by threshold values Vth designated from the CPU 34 and adding the quantized image to the image quantized in the previous frame in unit of dots, a memory 33 for storing the image data (added data added for each dot) quantized in the image information extraction unit 32 and added for each frame and accessed by the CPU 34 according to need to extract the data, a CPU 34 for reading out the image data stored in the memory 33, monitoring the deterioration degree for each pixel, and outputting a γ-conversion table that performs the suitable γ-correction for each pixel (selecting and designating the γ-conversion table) for the image processing unit 35 when burn-in becomes remarkable, and an image processing unit 35 for performing the γ-correction for reducing the deterioration for each pixel for each color based on the γ-conversion table instructed from the CPU 34, so the following effects can be obtained.

Namely, by just mounting a small size memory, the deterioration in the luminance of each pixel can be corrected for each pixel at a point in a free range from 1 frame to over about 3 years. Further, no matter what the application such as a personal computer (PC), a television (TV), etc., the deterioration of the luminance of the fixed display unit becomes unnoticeable. Further, the overall variation in luminance deterioration can be suppressed by just preparing two γ-tables. As a result, this can be realized by just adding the small size circuit of an existing IC, so realization is easy.

The deterioration of a fixed display unit can be made unnoticeable without changing the γ-curve of the input and the output.

Further, many equations and memories were used for computing the amount of deterioration of each pixel up to now, but according to the present embodiment, there is very little computation involved in the correction, so a high speed CPU for image processing is not required, and the computation is very easily carried out.

Further, when mounting this function on a substrate, by mounting this function at part of an IC such as the timing generator, it is possible to realize the present function without affecting the mechanism of the currently existing displays without the need for a special peripheral circuit.

Further, the partial pixel deterioration when fixed images are prevalent such as in personal computers (PC) and games can be suppressed. Further, by storing the deterioration degree information in units of 1 field, high precision computation for correction can be carried out for each pixel. Further, by limiting the cases where the γ-conversion is carried out, there is the advantage that the burn-in correction suppressing a strange feeling in the image quality as much as possible can be realized.

In particular, as regards to utilization in industry, partial pixel deterioration due to a fixed display such as a clock displayed on a TV screen etc. can be suppressed, so the invention can be applied to a timing generator used in a flat display such as an organic EL display or a liquid crystal display.

Summarizing the effects of the present invention, the present invention can correct the deterioration degree of the light emitting elements of the pixels accompanying aging for each pixel and, even if the degree of deterioration of the light emitting elements of the pixels accompanying aging is advanced, can supplement the amount of deterioration of the luminance. By limiting the cases for γ-conversion, it is possible to prevent burn-in and thereby keep strangeness in the image quality to a minimum.

While the invention has been described with reference to specific embodiment chosen for purpose of illustration, it should be apparent that numerous modifications could be made thereto by those skilled in the art without departing from the basic concept and scope of the invention.

I claim:

1. An image processing apparatus comprising:

a deterioration degree information extracting means for digitalizing an input image signal and extracting luminance deterioration degree information based on the digitalized information, wherein said deterioration degree information extracting means receives threshold values corresponding to respective pixels of the input image signal and quantizes the input image signal according to said threshold values to provide numerical values indicative of the degree of deterioration of the respective pixels of the input image signal as the luminance deterioration degree information, wherein the deterioration degree information extracting means increases a resolution of the threshold values for quantizing the input image signal at a high gradation side as the luminance deterioration of the pixels advances;

an image conversion designating means for selecting and designating an optimum image conversion method based on the luminance deterioration degree information obtained by said deterioration degree information extracting means; and an image processing means for performing conversion processing on the input image based on the optimum image conversion method designated by said image conversion designating means.

2. An image processing apparatus as set forth in claim 1, wherein the apparatus has a storing means for storing the luminance deterioration degree information extracted by said deterioration degree information extracting means, and said image conversion designating means selects the optimum image conversion method based on the luminance deterioration degree information stored in said storing means and designates the same to said image processing means.

3. An image processing apparatus as set forth in claim 2, wherein said deterioration degree information extracting means adds the digitalized image to the image digitalized in a previous frame in units of dots and stores the added data for each pixel in said storing means.

4. An image processing apparatus as set forth in claim 3, wherein said image conversion designating means calculates the deterioration degree by referring to the added data of the luminance deterioration degree information stored in said storing means and, when a luminance difference between a pixel having a small deterioration degree and a pixel having a large deterioration degree becomes larger than a reference value set in advance, selects a conversion method giving a small luminance difference and designates the same to said image processing means.

5. An image processing apparatus as set forth in claim 3, wherein said image conversion designating means calculates the deterioration degree by referring to the added data of the luminance deterioration degree information stored in said storing means and, when a luminance difference between a pixel having the smallest deterioration degree and a pixel having the largest deterioration degree becomes larger than a reference value set in advance, selects a conversion method giving a small luminance difference and designates the same to said image processing means.

6. An image processing apparatus as set forth in claim 4, wherein said conversion method includes a γ-conversion method, said image conversion designating means supplies γ-conversion table information to said image processing unit, and said image processing unit performs γ-correction for making the luminance difference small for each pixel based on the γ-conversion table.

7. An image processing apparatus as set forth in claim 5, wherein said conversion method includes a γ-conversion method, said image conversion designating means supplies γ-conversion table information to said image processing unit, and said image processing unit performs γ-correction for making the luminance difference small for each pixel based on the γ-conversion table.

8. The image processing apparatus as set forth in claim 1, wherein said deterioration degree information extracting means provides higher resolution of the threshold values for quantizing the input image signal at a low gradation side in an initial state.

9. An image processing method comprising:

a first step of digitalizing an input image signal, wherein digitalizing the input image signal comprises receiving threshold values corresponding to respective pixels of the input image signal and quantizing the input image signal according to the threshold values to provide numerical values indicative of the degree of deterioration of the respective pixels of the input image signal as luminance deterioration degree information, wherein digitalizing the input image signal increases a resolution of the threshold values for quantizing the input image signal at a high gradation side as the luminance deterioration of the pixels advances;

a second step of obtaining the luminance deterioration degree information based on the digitalized information;

a third step of storing said obtained luminance deterioration degree information;

a fourth step of monitoring said stored luminance deterioration degree information and selecting and designating an optimum image conversion method in accordance with the luminance deterioration degree; and a fifth step of performing conversion processing on the input image signal based on said designated optimum image conversion method.

10. An image processing method as set forth in claim 9, wherein obtaining luminance deterioration degree information comprises adding the digitalized image to the image digitalized in a previous frame in units of dots, and storing the added data for each pixel.

11. An image processing method as set forth in claim 10, wherein when a luminance difference between a pixel having a small deterioration degree and a pixel having a large deterioration degree becomes larger than a reference value set in advance, designating the optimum conversion method comprises selecting a conversion method giving a small luminance difference.

12. An image processing method as set forth in claim 10, wherein when a luminance difference between a pixel having the smallest deterioration degree and a pixel having the largest deterioration degree becomes larger than a reference value set in advance, designating the optimum conversion method comprises selecting a conversion method giving a small luminance difference.

13. An image processing method as set forth in claim 11, wherein the optimum conversion method includes a γ-conversion method, and γ-conversion table information is supplied in support of γ-correction for making the luminance difference small for each pixel based on the γ-conversion table.

14. An image processing method as set forth in claim 12, wherein the optimum conversion method includes a γ-conversion method, and γ-conversion table information is supplied in support of γ-correction for making the luminance difference small for each pixel based on the γ-conversion table.

15. The image processing method as set forth in claim 9, wherein digitalizing the input image signal provides higher resolution of the threshold values for quantizing the input image signal at a low gradation side in an initial state.

* * * * *